US005120207A

United States Patent [19]

Söderlund

[11] Patent Number: 5,120,207

[45] Date of Patent: Jun. 9, 1992

[54] ROTARY SCREW COMPRESSOR WITH INLET CHAMBER

[75] Inventor: Frits Söderlund, Saltsjöbaden, Sweden

[73] Assignee: Svenska Rotor Maskiner AB, Stockholm, Sweden

[21] Appl. No.: 720,539

[22] PCT Filed: Jan. 12, 1990

[86] PCT No.: PCT/SE90/00026

§ 371 Date: Jun. 24, 1991

§ 102(e) Date: Jun. 24, 1991

[87] PCT Pub. No.: WO90/08901

PCT Pub. Date: Aug. 9, 1990

[30] Foreign Application Priority Data

Feb. 1, 1989 [SE] Sweden ..... 8900353

[51] Int. Cl.[5] ..... F04C 18/16; F04C 29/02

[52] U.S. Cl. ..... 418/181; 418/201.1

[58] Field of Search ..... 418/181, 201.1

[56] References Cited

U.S. PATENT DOCUMENTS

| | | | |
|---|---|---|---|
| 2,963,884 | 12/1960 | Munck af Rosenschöld | 417/350 |
| 4,452,575 | 6/1984 | Schibbye et al. | 418/201.1 |
| 4,761,123 | 8/1988 | Sowards | 418/201.1 |
| 4,762,469 | 8/1988 | Tischer | 417/279 |

*Primary Examiner*—Richard A. Bertsch
*Assistant Examiner*—David L. Cavanaugh
*Attorney, Agent, or Firm*—Frishauf, Holtz, Goodman & Woodward

[57] ABSTRACT

The invention relates to a rotary screw compressor with liquid-injection means. The axes of the rotors (18, 20) are in a horizontal plane and the inlet channel (26) reaches the compressor from below. According to the invention there are provided means for preventing that liquid leaking out from the working space of the compressor through the inlet port (46) reaches the inlet channel (26). These means include partition walls (34, 36) mounted in an inlet chamber (28) connecting the inlet channel (26) to the inlet port (46).

8 Claims, 1 Drawing Sheet

ROTARY SCREW COMPRESSOR WITH INLET CHAMBER

BACKGROUND OF THE INVENTION

The present invention relates to a rotary screw compressor having a casing defining a working space, in which a pair of rotors is mounted with the rotor axes in a horizontal plane, said casing having an inlet channel and having means for injecting a liquid into said working space, said working space having an inlet port communicating with said inlet channel through an inlet chamber, the connection between said inlet channel and said inlet chamber being located below said horizontal plane.

Rotary screw compressors are well known and widely used for producing compressed air or in refrigeration systems, and their general structure and working principle therefore need not to be explained.

U.S. Pat. No. 4,762,469 discloses a compressor of the type specified above. A horizontally mounted compressor having the inlet channel coming from below offers in many cases advantageous solutions how to design the system in which the compressor forms a part. A compressor in a refrigeration or heat pump system can for example be mounted on the top of the evaporator with the downwardly directed inlet flange of the compressor directly connected to the upwardly directed outlet flange of the evaporator. U.S. Pat. No. 2,963,884 discloses a similar type of compressor, although intended for air compression and not being liquid-injected.

With a compressor so mounted, however, a certain problem can arise. If the compressor is of the type having means for injecting a liquid, e.g. oil into the working space for sealing, lubricating and cooling purposes, the oil by gravity might flow down into the inlet channel. If the inlet channel is connected to a lower located evaporator, the evaporator will be filled with oil and its efficiency negatively affected. In case the compressor is provided with a slide valve for regulating the capacity this problem will be considerably accentuated at part load, since with the recirculation of working fluid a large quantity of the oil will be returned to the inlet port.

The object of the present invention is to avoid that liquid injected into the compressor will flow back to the inlet channel.

According to the invention this has been attained in that said inlet chamber is provided with partition wall means collecting any liquid leading out from the working space through the inlet port and preventing it from reaching the inlet channel.

Advantageous embodiments of the invention are specified in the dependent claims.

The invention is explained more in detail by the following description of a preferred embodiment thereof and with reference to the accompanying drawings.

DETAILED DESCRIPTION

Figure 1:
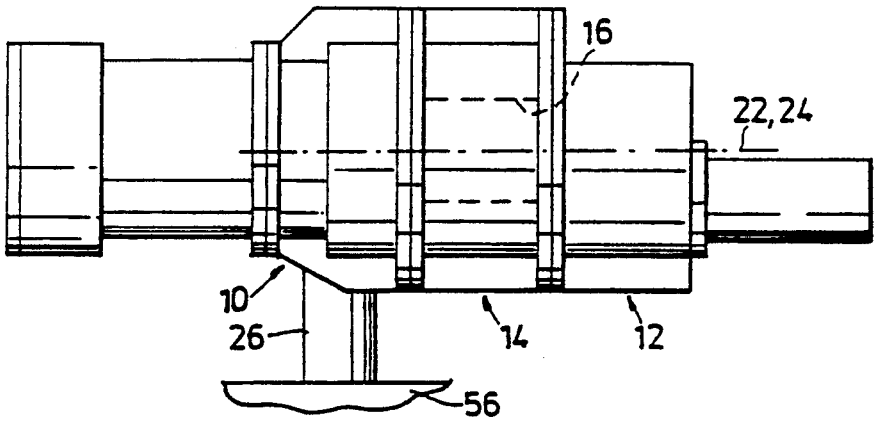
FIG. 1 is a schematic side view of a compressor according to the invention.

FIG. 1 shows a rotary screw compressor forming a part of a refrigeration system. The compressor comprises an inlet end section 10, an outlet end section 12 and a barrel section 14 extending therebetween. In the barrel section 14 a working space 16 is formed, in which a pair of screw rotors 18, 20 meshingly cooperate to form compression chambers. The axes 22, 24 of the rotors are located in a horizontal plane and define the axial direction of the compressor. The compressor has an inlet channel 26 connected to an evaporator 56. Gaseous working fluid is sucked from the evaporator 56 through the inlet channel 26 into an inlet chamber 28 contained in the inlet end section 10. Through an inlet port 46 the working fluid flows from the inlet chamber 28 into the working space 16 where it is compressed.

Figure 2:
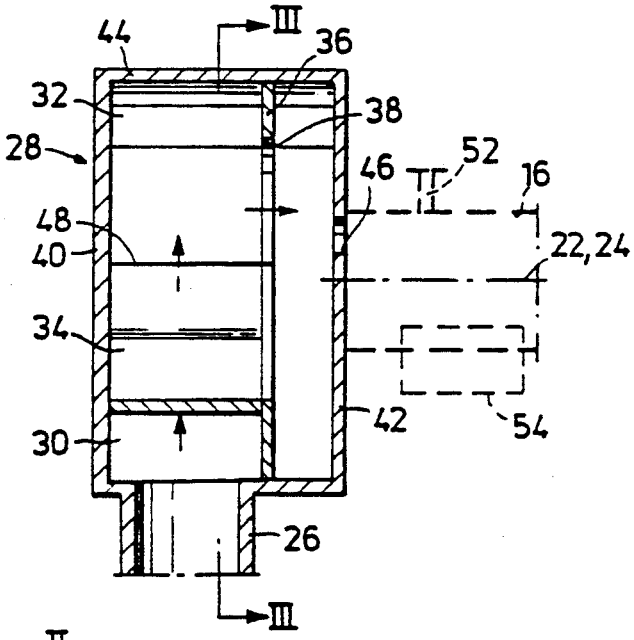
FIG. 2 is a simplified vertical section through the inlet chamber of a compressor according to the invention take along line II—II of FIG. 3.
Figure 3:
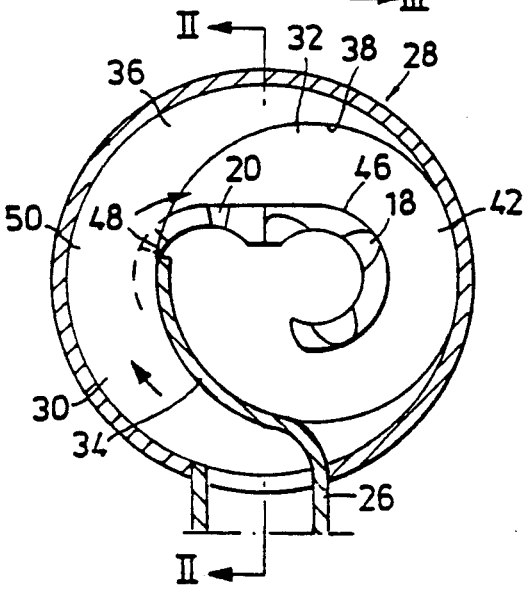
FIG. 3 is a vertical section taken along lie III—III of FIG. 2.

FIGS. 2 and 3 show the inlet end section 10 more in detail. The inlet end section 10 has an outer end wall 40, an inlet port plate 42 and a barrel wall 44, which limit the inlet chamber 28. The inlet chmber 28 is divided into two sections 30, 32 by two partition walls 34, 36. One of the partition walls 36 is located in a radial plane and has a circular opening 38. The other partition wall 34 extends axially between the radial partition wall 36 and the outer end wall 40. As best can be seen in FIG. 3 the axial partition wall 34 in its upper part follows the circumference of the opening 38 in the radial partition wall 36 about 90°, ending in an upper edge 48, and the lower part is almost radial, connecting the circular part with the inlet channel connection.

By the partition walls 34, 36 the inlet chamber 28 is divided into fist 30 and second 32 sections. The first section 30 communicates with the inlet channel 26 and is limited by the radial partition wall 36 and the outer end wall 40 and the axial partition wall 34 and the adjacent part of the barrel wall 44. The rest of the inlet chamber 28 constitutes the second section 32 which communicates with the working space 16 through the inlet port 46. The first section 30 of the inlet chamber 28 thus extends in the axially outer part hereof from the inlet channel 26 circumferentially up to a level corresponding to the location of the upper edge 48 of the axial partition wall 34. The two sections 30, 32 communicate with each other through the horizontal opening 50 formed by the partition walls 34, 36, the outer end wall 409 and the barrel wall 44, where the axial partition wall 34 ends in its upper edge 48.

The working fluid coming from the inlet channel 26 first flows through the first section 30 of the inlet chamber 28. When the fluid has reached the upper edge 48 of the axial partition wall 34 it flows through the opening 50 into the second section 32 and from there through the inlet port 46 into the working space 16 of the compressor.

The compressor is provided with means 52 for injecting oil into the working space 16. Oil leaking out from the working space 16 into the inlet chamber 28 is by the partition walls 34, 36 prevented from reaching the first section 30 of the inlet chamber 28 and will be trapped in the second section 32. The oil therefore cannot flow to the evaporator 56. An axially displaceable slide valve 54 regulates the compressor capacity, in a manner well known. At part load the tendency of the oil to leak out through the inlet port 46 is considerably increased due to the recirculation of working fluid.

In the embodiment of the invention described above the inlet chamber is located at the side of the working space in the end section, the inlet port being mainly axial. It is, however, to be understood that the invention in no ways is limited to this type of arrangement. It can as well be applied to compressors having mainly radial inlet ports and to compressors having the inlet chamber located elsewhere, e.g. below the working space.

I claim:

1. Rotary screw compressor having a casing defining a working space (16) in which a pair of rotors (18, 20) is mounted with the rotor axes (20, 22) in a horizontal plane, said casing having an inlet channel (26) and having means (52) for injecting a liquid into said working space (16), said working space (16) having an inlet port (46) communicating with said inlet channel (26) through an inlet chmber (28), the connection between the sad inlet channel (26) and said inlet chamber (28) being located below said horizontal plane, wherein said inlet chamber (28) is provided with partition wall means (34, 36) for collecting any liquid leaking out from said working space (16) through said inlet port (46) and preventing it from reaching said inlet channel (26).

2. Compressor according to claim 1, in which said partition wall means (34, 36) divides said inlet chamber (28) into a first section (30) facing said inlet channel (26) and a second section (32) facing said inlet port (46), which first (30) and second (32) sections communicate with each other through an opening (50) formed by said partition wall means (34, 36).

3. Compressor according to claim 2, in which said casing includes a barrel section (14) and an inlet end section (10) on one end of said barrel section (14), said inlet chamber (28) being located in said inlet end section (10).

4. Compressor according to claim 3, in which said opening (50) is located at a level above the lowermost part of said inlet port (46).

5. Compressor according to claim 4, in which said opening (50) is located above said horizontal plane.

6. Compressor according to any one of claim 3 to 5, in which said partition wall means (34, 36) includes a radially extending partition wall (36) and an axially extending partition wall (34), said axially extending partition wall having an upper edge (48) determining the location of said opening (50).

7. Compressor according to any one of claim 1 to 5, further comprising valve means (54) for regulating the capacity of the compressor.

8. Compressor according to claim 7 being a part of a refrigeration or heat pump system including an evaporator (56) connected to the compressor through said inlet channel (26).

* * * * *